US006273587B1

(12) United States Patent
Demshki

(10) Patent No.: US 6,273,587 B1
(45) Date of Patent: Aug. 14, 2001

(54) LIGHT STRIP POWER BLOCK

(75) Inventor: Robert Demshki, Cherryville, NC (US)

(73) Assignee: Ardee Lighting/USA, INC, Shelby, NC (US)

( * ) Notice: Subject to any disclaimer, the term of this patent is extended or adjusted under 35 U.S.C. 154(b) by 0 days.

(21) Appl. No.: 09/457,082

(22) Filed: Dec. 7, 1999

(51) Int. Cl.[7] ..... F21V 21/00
(52) U.S. Cl. ..... 362/249; 362/219; 362/226
(58) Field of Search ..... 362/219, 226, 362/249, 396

(56) References Cited

U.S. PATENT DOCUMENTS

| | | | |
|---|---|---|---|
| 1,967,021 | 7/1934 | Gary | 439/677 |
| 2,069,238 | 2/1937 | Fraser | 362/226 |
| 2,091,597 | 8/1937 | La Force | 174/61 |
| 3,200,365 | 8/1965 | Carpinone | 439/473 |
| 3,246,074 | 4/1966 | Neumann | 174/48 |
| 3,500,036 | 3/1970 | Szentveri | 362/152 |
| 4,493,516 | 1/1985 | Attema | 439/111 |
| 4,979,081 | 12/1990 | Leach et al. | 362/219 |
| 5,310,355 | 5/1994 | Dannatt | 439/110 |

*Primary Examiner*—Alan Cariaso
*Assistant Examiner*—Ronald E. DelGizzi
(74) *Attorney, Agent, or Firm*—Fitzpatrick, Cella, Harper & Scinto

(57) ABSTRACT

A light strip power block is disclosed which includes a base, a cover for the base having an opening formed therein for receiving an electrical power supply cable of the type having an outer protective sheathing and at least two interior power leads. The cable is secured to the base in a fixed position against movement relative to the base and a terminal block mounted on the base which includes a first pair of adjacent electrical contacts for respectively receiving the power leads of the power supply cable and a second pair of adjacent electrical contacts opposite to and electrically connected with the first pair for respectively receiving the electrical contact leads of a light strip whereby power is supplied from the cable to the light strip.

11 Claims, 6 Drawing Sheets

LIGHT STRIP POWER BLOCK

BACKGROUND OF THE INVENTION

1. Field of the Invention

The present invention relates to power supply modules and particularly power supply modules for use with strip lighting fixtures.

2. Description of the Related Art

Strip lighting fixtures used to illuminate the interior of furniture pieces or to provide decorative and accent lighting are known in the art. These types of fixtures are typically formed from an elongated track of insulating material which is formed in a flat strip and contains a series of electrical connections or clips for mounting cylindrical glass bulbs. The flat strip includes a pair of electrical contact leads along its opposite edges which connect alternately with the bulb clips to provide current to the bulb. Strip lighting fixtures of this type are shown for example in U.S. Pat. No. 4,979,081. While such fixtures have been found to be highly desirable in use, connecting the contact leads of the strips to conventional electrical supply boxes, is often awkward or unpleasing in appearance.

SUMMARY OF THE INVENTION

It is an object of the present invention to provide power supply blocks for strip lighting fixtures of the type shown in U.S. Pat. No. 4,979,081 which are relatively simple in construction and pleasing in appearance.

Another object of the present invention is to provide a power supply block which allows for quick interconnection of the light strip to the block.

Yet another object of the present invention is to provide a quick, reliable and inexpensive structure for connecting light strips to electrical power supplies.

In accordance with an aspect of the present invention, power supply blocks which are suitable for connecting light strips to a current source either from Romex or BX cable are provided. The basic power block consists of a metal base and a plastic cover for the base. The cover has one or more openings formed therein for receiving an electrical power supply cable having an outer protective sheathing and at least two power leads. The cable can be a conventional Romex or BX cable. The block contains means for securing the power supply cable to the base in a fixed position against movement relative to the base. A terminal block is mounted on the base and has a first pair of adjacent electrical contacts for respectively receiving the power supply leads of the power supply cable. The terminal block further includes a second pair of adjacent electrical contacts opposite to and electrically connected with the first pair for respectively receiving the electrical contact leads of a light strip whereby power is supplied from the cable to the light strip.

In the Romex form of the invention, a clamp arrangement is provided as the means for securing the power supply cable to the base. The clamp arrangement includes a cable block mounted on the base and a clamping bar threaded down on the block to capture the Romex cable in a channel formed in the cable block. In the BX form of the cable the base has one or more pry-out openings formed therein so that the BX cable can enter the block through the opening and be secured to the base by conventional BX cable locking arrangements.

The above, and other objects, features and advantages of the invention will be apparent in the following detailed description of illustrative embodiments thereof, which is be read in connection with the accompanying drawings wherein:

DETAILED DESCRIPTION OF THE PREFERRED EMBODIMENT

Figure 1:
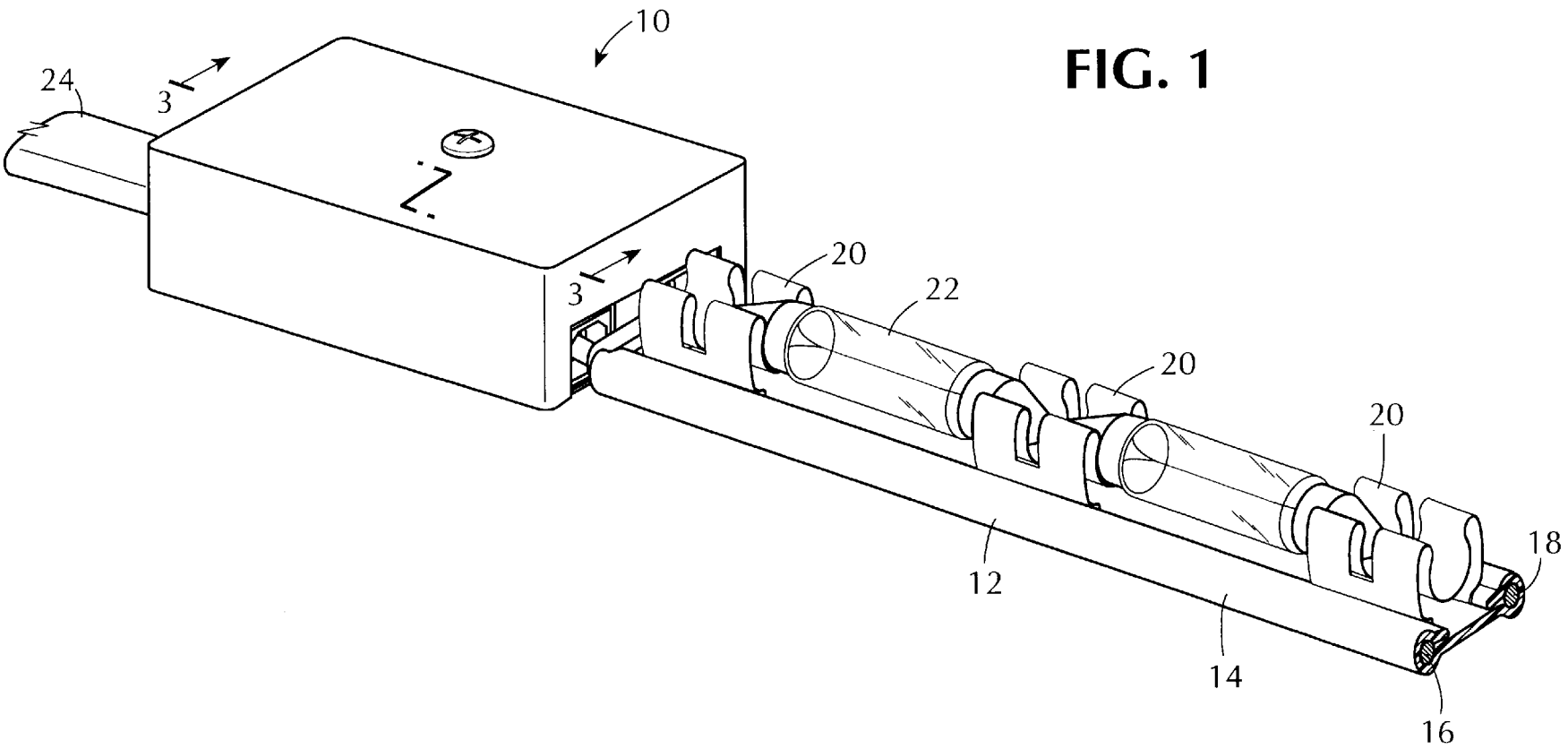
FIG. 1 is a perspective view of a light strip power supply block connected to a light strip in accordance with the present invention.

Referring now to the drawings in detail and initially to FIG. 1, a light strip power block 10 constructed in accordance with one embodiment of the invention is disclosed connected to a light strip 12. The light strip 12 is constructed in any convenient and known manner, such as for example as is disclosed in U.S. Pat. No. 4,979,081. The strip consists of a flexible strip or base 14 having positive and negative current supply leads 16, 18 formed in its opposite edges. The strip provides a support for a series of connector elements or clips 20 which are connected to one or the other of the power leads 16, 18. The clips support cylindrical incandescent bulbs 22 or the like in the known manner. When power is supplied to leads 16, 18, the bulbs are illuminated.

Power supply block 10, as described in detail hereinafter, allows for quick and simple plug-in type connection and assembly of the light strip to the block. The block is in turn connected to a power supply cable such as, for example, a strip of Romex cable 24 as illustrated in FIGS. 1–4.

Figure 2:
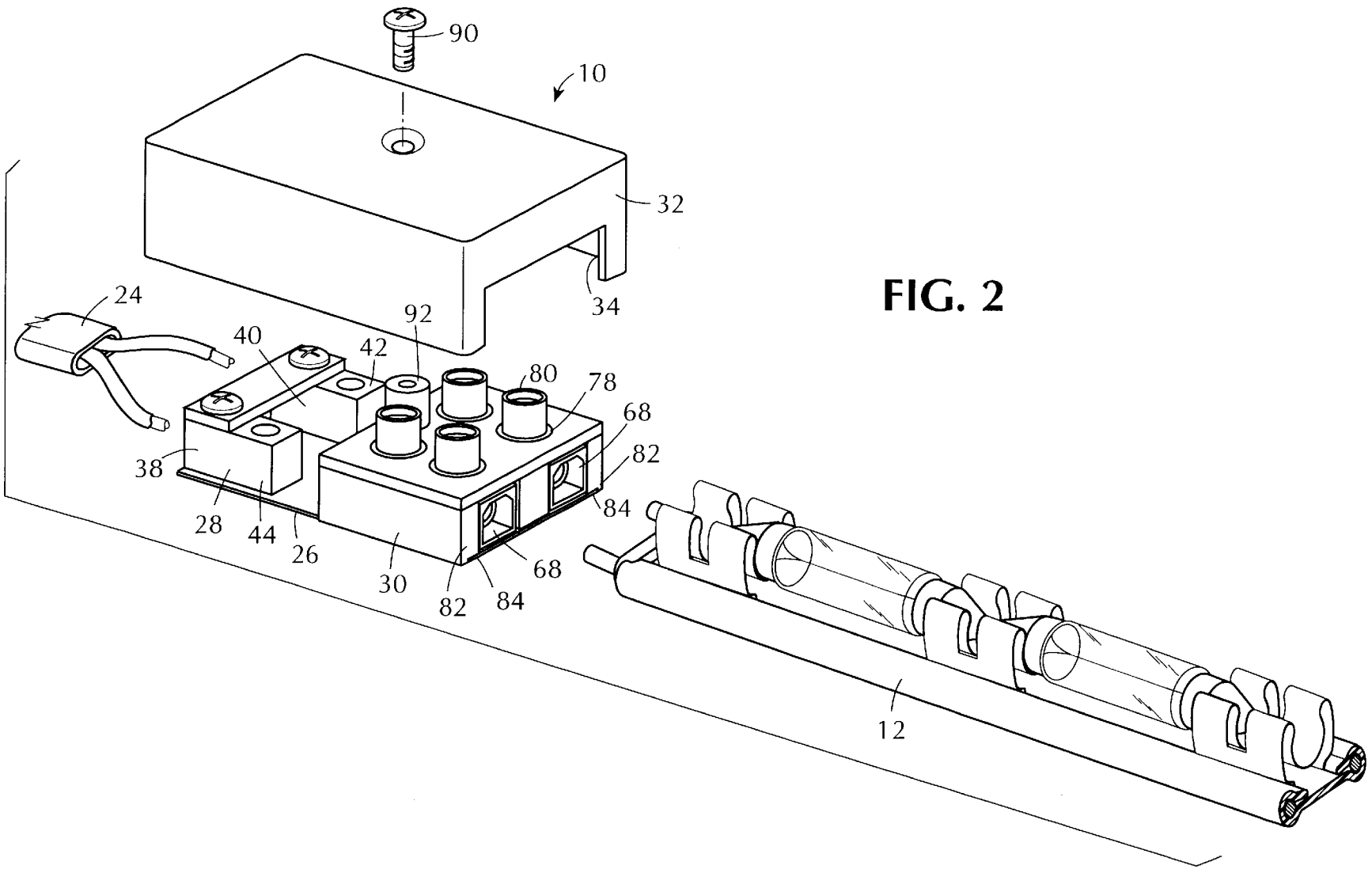
FIG. 2 is an exploded perspective view of FIG. 1.
Figure 3:
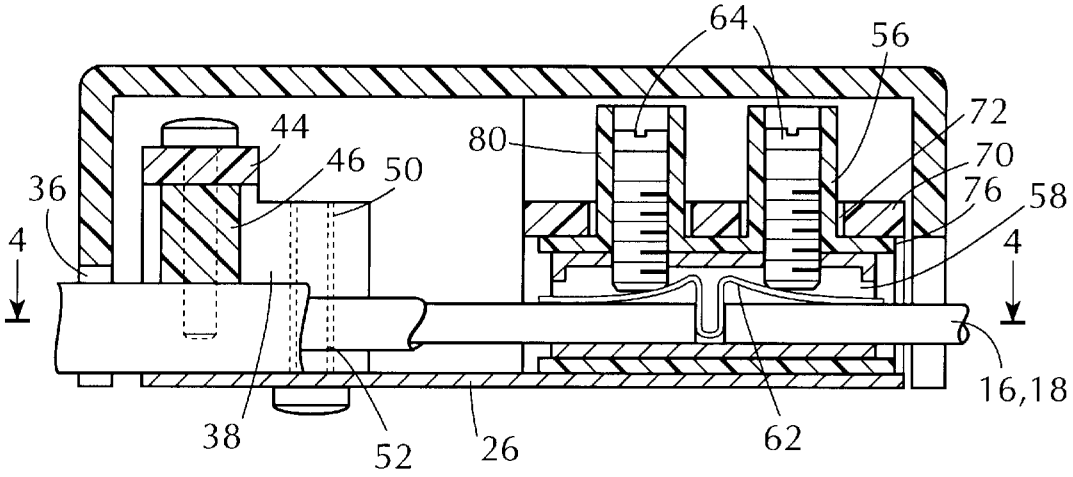
FIG. 3 is a sectional view taken along line 3—3 of FIG. 1.

Referring to FIGS. 2–3, power block 10 includes a base 26 formed of metal or the like. A power supply cable clamp 28 is mounted on base 26 adjacent to a terminal block 30. A cover 32 is provided to cover and insulate the assembly. Cover 32 has a front opening 34 and a rear opening 36 formed therein to allow access to the interior of the block by the Romex cable and/or power supply strip 12.

Figure 4:
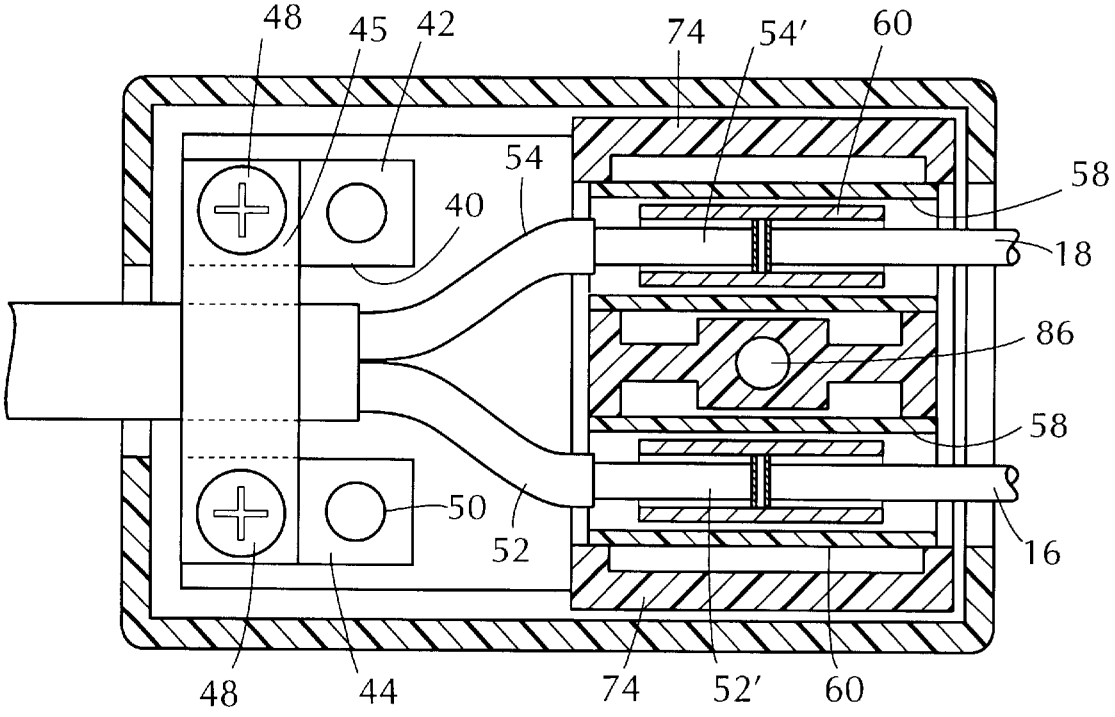
FIG. 4 is a sectional view taken along line 4—4 of FIG. 4.
Figure 5:
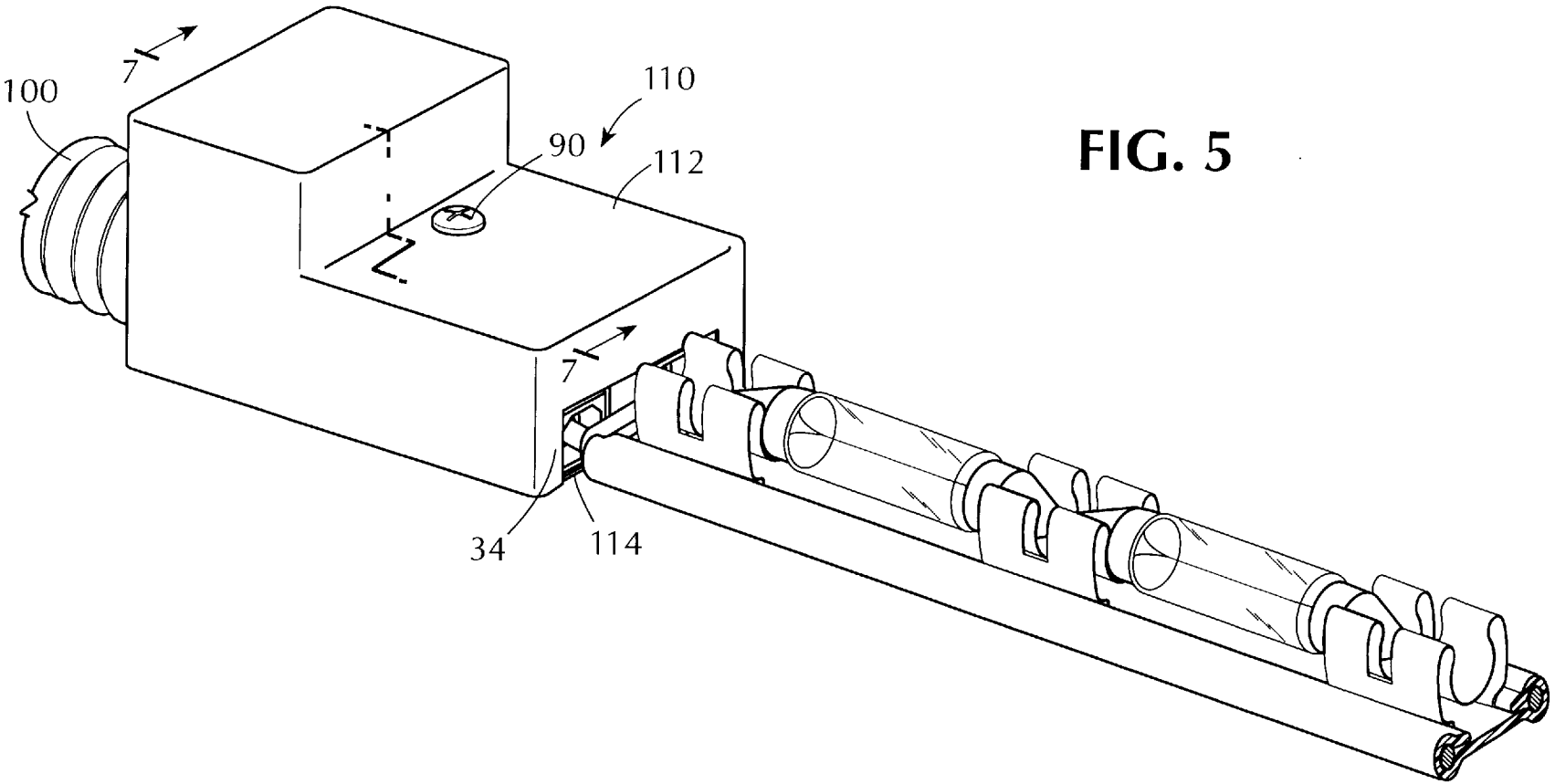
FIG. 5 is a perspective view of another embodiment of the present invention.

Clamp means 28 consists of an insulated block of material 38 which, as seen in FIG. 2, has a channel 40 formed between its sides 42, 44. Romex cable 24 fits in this channel, as seen in FIG. 3. It is held in place by a clamp bar 45 which extends across channel 40, as seen in FIG. 4 and has an integral cable pad 46 formed thereon. Pad 46 depends from bar 45 and engages the top of the Romex cable. When the bar is screwed into place by the screws 48 which enter the block 38, a clamping force is applied to the Romex cable.

Block 38 is secured to the base 26 in any convenient manner, as for example, by rivets 52 extending through the bottom of the base and into the bores 50 formed in the sides of block 38.

As is well known in the art, Romex cable contains 2 or more power leads 52, 54 in a plastic or rubber sheath. The ends of the leads 52', 54' are stripped to expose the metal leads in order to make electrical contact. In accordance with the present invention, a terminal block 56 is provided to which the leads are connected. The leads 16, 18 of the power strip also enter the same terminal block 56 to make an electrical connection with the power supply cable.

Terminal block 56 is itself of conventional construction. It contains a pair of through passages 58 formed of an electrically insulating material each of which contains within it a metal sleeve 60. These sleeves contain inverted U-shaped spring elements 62 which are respectively engaged by set screws 64. The U-shaped spring member provides a resilient contact for receiving either the wire leads 52', 54' or the light strip leads 16, 18. As will be understood by those skilled in the art, the leads are simply placed in the openings 68 defined by the conventional channel members until they engage the vertical surfaces of the U strip 62 as seen in FIG. 3, at which point the set screws 64 are tightened to firmly clamp the power leads within the terminal block.

Each terminal block is provided with a terminal cap 70 which aids in securing the terminal block to the base in order to hold it firmly in place against movement. The cap is also formed of a thermo plastic or plastic electrically insulating material. It has a top surface 72 and side walls 74. The inner surface 76 of the cap is generally complementary in shape to the surface of the terminal block. The cap has four openings 78 formed in it which receive the collars 80 of the terminal block in which set screws 64 are located. The side walls have lower edges 82 which rest on the surface of the base 16 and have edge extensions 84 which lie along the sides of the base. A rivet, similar to the rivets 52 previously discussed is inserted through base 26 and the central opening 86 of the terminal block into the cap 72, thereby to secure the cap and terminal block to the base. The side edges of the cap prevent the terminal block from twisting about the base. As a result, the terminal block stays securely aligned with the opening 34 in cover 32 so that the light strip is easily mated to the terminal block to accept power from the Romex cable.

Finally, cover 32 is secured in place on the base by a screw 90 which threadedly engages a boss 92 formed on the top surface of the cap. As a result of this construction a relatively simple terminal block is provided which insures positive connection to the light strip. The terminal block is easily assembled by the electrician and firmly clamps the Romex cable in place against movement.

Figure 6:
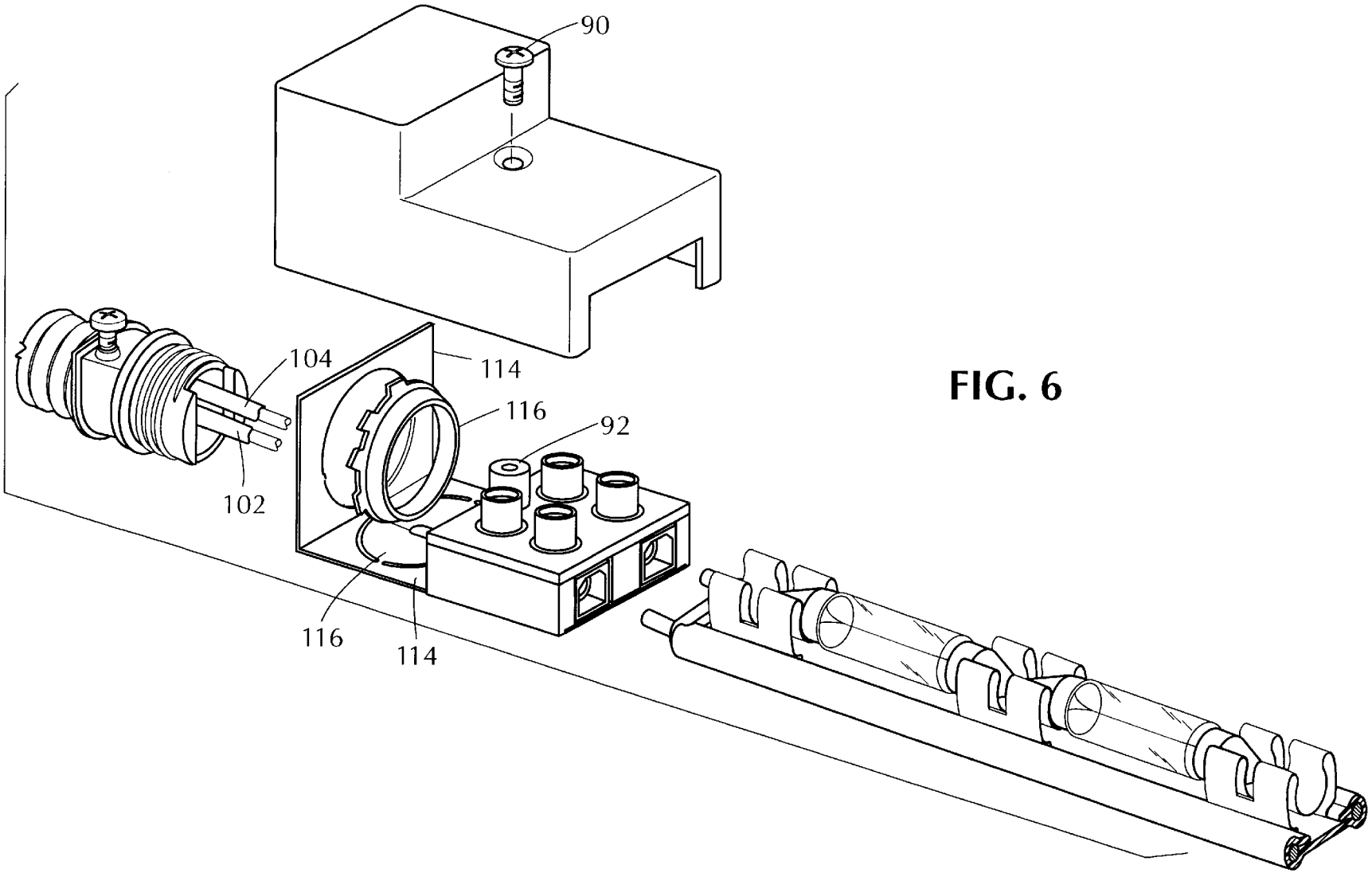
FIG. 6 is an exploded perspective view of the embodiment of FIG. 5.

FIGS. 5–8 illustrate a form of the invention used with BX cable 100. As is well known in the art, BX cable is a metal sheath or clad cable which contains electrical power leads 102, 104 therein. In this embodiment of the invention the power block 110 includes a cover 112 and an L-shaped based member 114. As seen in FIG. 6, the L-shaped member 114 has one or more pry-out disk 116 formed therein. The pry-out disk 116 in the horizontal leg shown in FIG. 6 is illustrated in place while the pry-out disk in the vertical leg has been removed from the vertical leg and is shown in phantom lines.

Figure 7:
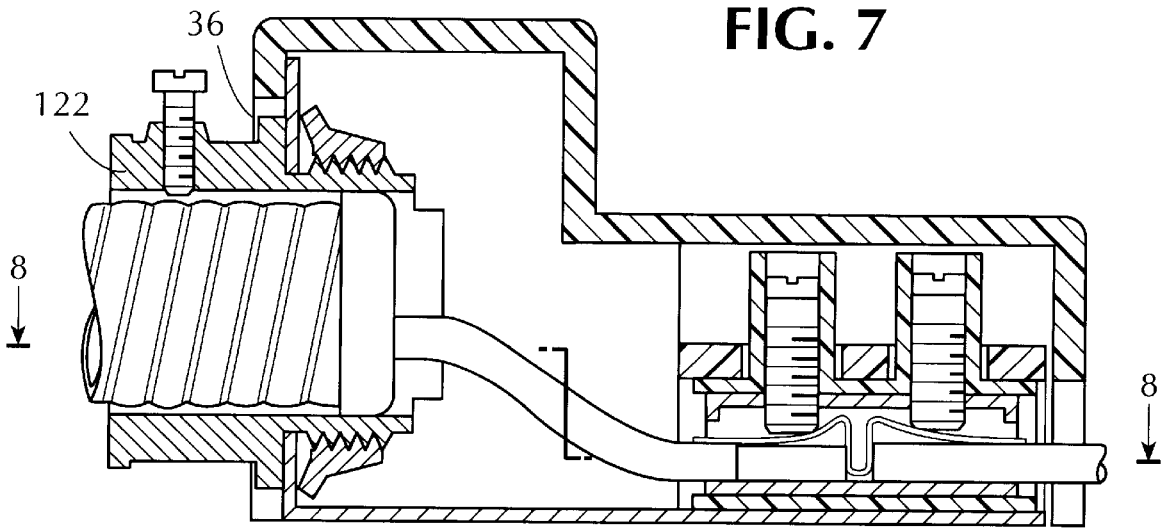
FIG. 7 is a sectional view taken along line 7—7 of FIG. 5.
Figure 8:
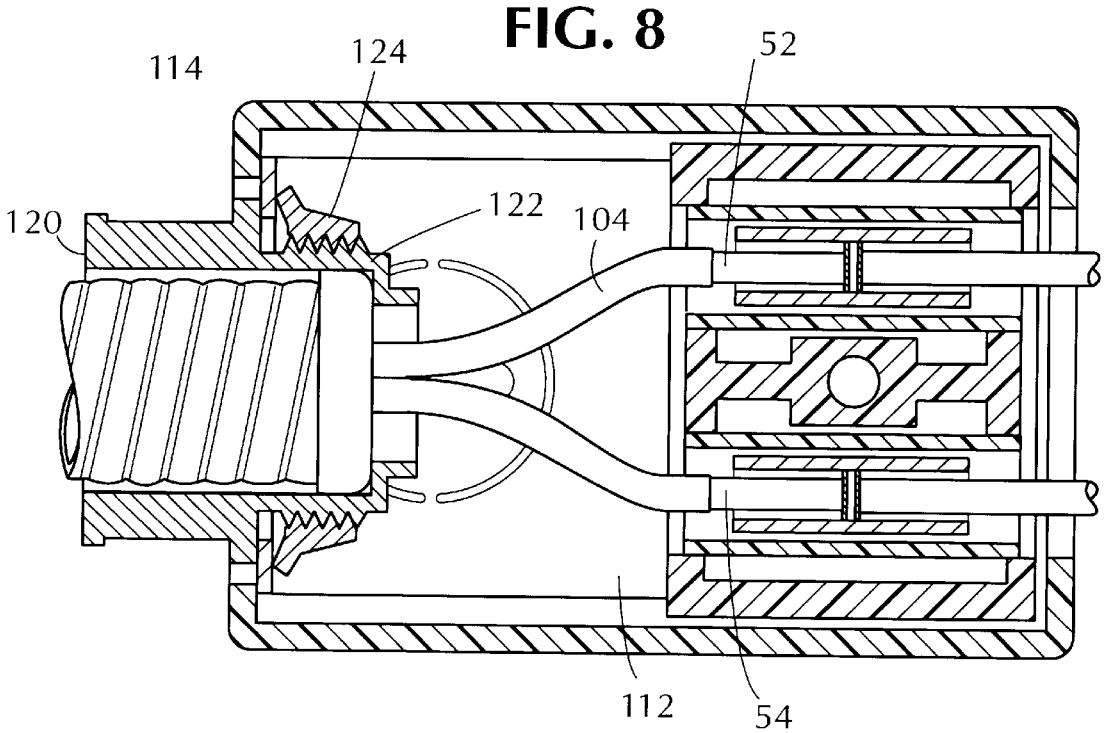
FIG. 8 is a perspective view taken along line 8—8 of FIG. 7.

By prying out one of the disks, as illustrated in FIGS. 6 and 7, the BX cable can be passed through the opening formed by the removed disk and clamped in place to the base using conventional BX cable clamping technology. For example, a circular washer 120 having a threaded neck 122 can be provided which slips over the end of the BX cable 104 in the known manner. The lock washer is fixed on the BX cable by a set screw 122 or the like. A nut 124 is provided within the interior of the power block to thread on the neck of the lock washer and draw the clamp against the upright wall of base 114 to clamp the BX cable in place. Alternative forms of BX cable clamps, including two-piece clamp members with an integral threaded neck would be suitable for use as well and would be understood by, those skilled in the art.

In this embodiment of the invention a terminal block and cap identical to that previously described with respect to the embodiment of FIGS. 1–4 are mounted on the base 114 in line with the opening formed by the pry-out disk to receive the ends 52', 54' of the power supply cable as previously described. Here the terminal block has the same structure as that described above with respect to FIGS. 3 and 4 and the description thereof need not be repeated. However, it is again noted that the cap on the terminal block is designed to be complementary to the shape of the terminal block and its bottom edges lie along the edges of the base 112 to prevent twisting of the terminal block in the power block. As in the prior embodiment, the cover 112 is secured to the base by a screw 90 which threads into a boss 92 formed in the terminal block cap.

As will be understood by those skilled in the art, this structure for the power block is relatively simple in construction, but is reliable in use and quick to operate.

Although illustrative embodiments of the present invention have been described herein with reference to the accompanying drawings, it is to be understood that the invention is not limited to those precise embodiments, and that various changes and modifications may be affected therein by those skilled in the art without departing from the scope or spirit of this invention.

What is claimed is:

1. A light strip power block comprising a base, a cover for said base having an opening formed therein for receiving an electrical power supply cable having an outer protective sheathing and at least two power leads;

means for engaging said power supply cable in said base beneath and within said cover in a fixed position against movement relative to said base; and a terminal block mounted on said base beneath and within said cover;

said terminal block including a first pair of adjacent electrical contacts for respectively receiving the power leads of the power supply cable and a second pair of adjacent electrical contacts opposite to and electrically connected with said first pair for respectively receiving the electrical contact leads of a light strip through said cover whereby power is supplied from the cable to the light strip; and said means for engaging said power supply cable comprising a cable block mounted on said base beneath said cover and adjacent said cover opening; said cable block having an open channel formed therein for receiving the cable, a clamp mounted on said cable block beneath said cover across said channel and including means for engaging said cable and means for securing said clamp to said cable block.

2. A light strip power block as defined in claim 1, wherein said clamp is a bar extending across the channel and said means for engaging the cable comprises a pad extending from the bar into the channel towards said base.

3. A light strip power block as defined in claim 2 wherein said means for securing the clamp of the cable block comprises a pair of screws engaged in said bar and secured to said cable block on opposite sides of the channel.

4. A light strip power block as defined in claim 3 including means for securing said terminal block to said base.

5. A light strip power block as defined in claim 4 wherein said means for securing said terminal block to said base includes a cap having an interior surface generally complementary to the exterior surfaces of said terminal block and receiving and overlying said terminal block, said cap having base edges resting on said base and edge extensions located along the edges of the base to resist twisting, and means for securing the cap to the base.

6. A light strip power block as defined in claim 5 including means for securing said cover to said cap.

7. A light strip power block comprising a base, a cover for said base having an opening formed therein for receiving an electrical power supply cable having an outer protective sheathing and at least two power leads;

means for engaging said power supply cable in said base in a fixed position against movement relative to said base; and a terminal block mounted on said base;

said terminal block including a first pair of adjacent electrical contacts for respectively receiving the power leads of the power supply cable and a second pair of adjacent electrical contacts opposite to and electrically connected with said first pair for respectively receiving the electrical contact leads of a light strip whereby power is supplied from the cable to the light strip; and said base having at least one pry-out disk formed therein for forming an opening adapted to receive BX cable and said means for engaging said power supply cable comprises BX cable clamp assembly means for securing BX cable in said opening.

8. A light strip power block as defined in claim 7 wherein said base is generally L-shaped, having two legs, each of which has a pry-out disk formed therein.

9. A light strip power block as defined in claim 8 including means for securing said terminal block to one leg of said base.

10. A light strip power block as defined in claim 9 wherein said means for securing said terminal block to said base includes a cap having an interior surface generally complementary to the exterior surfaces of said terminal block and receiving and overlying said terminal block, said cap having base edges resting on said base and edge extensions located along the edges of the base to resist twisting, and means for securing the cap to the base.

11. A light strip power block as defined in claim 10 including means for securing said cover to said cap.

* * * * *